US006164762A

United States Patent [19]

Sullivan et al.

[11] Patent Number: 6,164,762

[45] Date of Patent: Dec. 26, 2000

[54] HEATER CHIP MODULE AND PROCESS FOR MAKING SAME

[75] Inventors: Carl Edmond Sullivan, Versailles; John Dennis Zbrozek, Lexington, both of Ky.

[73] Assignee: Lexmark International, Inc., Lexington, Ky.

[21] Appl. No.: 09/100,485

[22] Filed: Jun. 19, 1998

[51] Int. Cl.[7] ..... B41J 2/05

[52] U.S. Cl. ..... 347/56; 347/65

[58] Field of Search ..... 347/56, 65, 18, 347/19

[56] References Cited

U.S. PATENT DOCUMENTS

| | | | |
|---|---|---|---|
| 4,169,008 | 9/1979 | Kurth . | |
| 4,942,408 | 7/1990 | Braun | 347/65 |
| 4,985,710 | 1/1991 | Drake et al. | 347/18 |
| 5,016,023 | 5/1991 | Chan et al. . | |
| 5,057,854 | 10/1991 | Pond et al. . | |
| 5,066,964 | 11/1991 | Fukuda et al. | 347/18 |
| 5,084,713 | 1/1992 | Wong | 347/18 |
| 5,097,274 | 3/1992 | Drake et al. . | |
| 5,160,945 | 11/1992 | Drake . | |
| 5,192,959 | 3/1993 | Drake et al. . | |
| 5,198,054 | 3/1993 | Drake et al. . | |
| 5,218,754 | 6/1993 | Rangappan . | |
| 5,257,043 | 10/1993 | Kneezel . | |
| 5,322,594 | 6/1994 | Bol . | |
| 5,469,199 | 11/1995 | Allen et al. . | |
| 5,478,606 | 12/1995 | Ohkuma et al. . | |
| 5,506,608 | 4/1996 | Marler et al. | 347/19 |
| 5,528,272 | 6/1996 | Quinn et al. . | |
| 5,559,543 | 9/1996 | Komuro . | |
| 5,572,244 | 11/1996 | Drake et al. . | |
| 5,627,571 | 5/1997 | Anderson et al. . | |
| 5,719,605 | 2/1998 | Anderson et al. . | |
| 5,790,151 | 8/1998 | Mills . | |
| 5,804,083 | 9/1998 | Ishii et al. . | |
| 5,916,452 | 6/1999 | Kobayashi et al. . | |

FOREIGN PATENT DOCUMENTS

| | | |
|---|---|---|
| 0 822 078 A2 | 2/1998 | European Pat. Off. . |
| 0 822 080 A2 | 2/1998 | European Pat. Off. . |

OTHER PUBLICATIONS

"The Mechanism of Anisotropic Silicon Etching and Its Relevance for Micromachining" by H. Seidel (W. Germany), 1987.

"Formation of Silicon Reentrant Cavity Heat Sinks Using Anisotropic Etching & Direct Wafer Bonding", by A. Goyal, R.C. Jaeger, S.H. Bhavnani, C.D. Ellis, N.K. Phadke, M. Azimi–Rashti and J.S. Goodling (IEEE Electron Device Letters, Vol. 14, No. 1), 1993.

"Submicron Accuracies in Anisotropic Etched Silicon Piece Parts—A Case Study" by T. L. Poteat, 1985.

Carl Edmond Sullivan, "Micromachined Vias for Ink Jet Printing"—A Thesis Submitted to the Faculty of the University of Louisville Speed Scientific School, Dept. of Electrical Engineering, first available to the public between Aug. 12, 1996 and Sep. 30, 1996, 83 pages.

(List continued on next page.)

*Primary Examiner*—John Barlow
*Assistant Examiner*—An H. Do
*Attorney, Agent, or Firm*—Michael T. Sanderson

[57] ABSTRACT

A heater chip module is provided comprising a carrier adapted to be secured to an ink-filled container, at least one heater chip having a base coupled to the carrier, and at least one nozzle plate coupled to the heater chip. The carrier includes a support section provided with two or more channels which define paths for ink to travel from the container to the heater chip. The heater chip is secured at its base to the support section. Carrier material located between the channels define ribs which provide a path for energy in the form of heat to travel from the heater chip to the carrier. A flexible circuit is coupled to the heater chip module such as by TAB bonding or wire bonding.

19 Claims, 9 Drawing Sheets

OTHER PUBLICATIONS

"Compensation Structures for Convex Corner Micromachining in Silicon" by B. Puers and W. Sansen (Katholieke Universiteit Lewen, Belgium), 1990.

"Orientation of the Third Kind; The Coming of Age of (110) Silicon" by D.L. Kendall and G.R. de Guel (Elsevier Science Publishers, Amsterdam), 1985.

H. T. Henderson & W. Hsieh, "Micromachining in Semiconductors as an On–Chip Manufacturing Technique for Micro–Electromechanical Systems," Proceedings, ASEE N. Central Spring Mtg, Southfield, MI, Apr. 7, 1989.

U. Schnakenberg, W. Benecke, and P. Lange, THAHW Etchants for Silicon Micromachining, In Proc. Int. Conf. on Solid State Sensors and Actuators (Transducers 1991) pp. 815–818, San Francisco, Jun. 1991.

The Mechanism of Anisotropic, Electromechanical Silicon Etching in Alkaline Solutions, by H. Seidel (Federal Republic of Germany), 1990.

"KOH Etch Rates of High–Index Planes from Mechanically Prepared Silicon Crystals" by E. Herr & H. Baltes (Physical Electronics Laboratory, Zurich, Switzerland), 1991.

HEATER CHIP MODULE AND PROCESS FOR MAKING SAME

CROSS-REFERENCE TO RELATED APPLICATIONS

This application is related to contemporaneously filed patent applications U.S. Ser. No. 09/100,070, entitled "AN INK JET HEATER CHIP MODULE WITH SEALANT MATERIAL"; U.S. Ser. No. 09/100,544, entitled "AN INK JET HEATER CHIP MODULE"; U.S. Ser. No. 09/009,854, entitled "A PROCESS FOR MAKING A HEATER CHIP MODULE"; U.S. Ser. No. 09/100,538, entitled "A HEATER CHIP MODULE FOR USE IN AN INK JET PRINTER"; and U.S. Ser. No. 09/100,218, entitled "AN INK JET HEATER CHIP MODULE INCLUDING A NOZZLE PLATE COUPLING A HEATER CHIP TO A CARRIER," the disclosures of which are incorporated herein by reference.

FIELD OF THE INVENTION

This invention relates to a heater chip module adapted to be secured to an inkfilled container and a process for making same.

BACKGROUND OF THE INVENTION

Drop-on-demand ink jet printers use thermal energy to produce a vapor bubble in an ink-filled chamber to expel a droplet. A thermal energy generator or heating element, usually a resistor, is located in the chamber on a heater chip near a discharge nozzle. A plurality of chambers, each provided with a single heating element, are provided in the printer's printhead. The printhead typically comprises the heater chip and a nozzle plate having a plurality of the discharge nozzles formed therein. The printhead forms part of an ink jet print cartridge which also comprises an ink-filled container.

A plurality of dots comprising a swath of printed data are printed as the ink jet print cartridge makes a single scan across a print medium, such as a sheet of paper. The data swath has a given length and width. The length of the data swath, which extends transversely to the scan direction, is determined by the size of the heater chip.

Printer manufacturers are constantly searching for techniques which may be used to improve printing speed. One possible solution involves using larger heater chips. Larger heater chips, however, are costly to manufacture. Heater chips are typically formed on a silicon wafer having a generally circular shape. As the normally rectangular heater chips get larger, less of the silicon wafer can be utilized in making heater chips. Further, as heater chip size increases, the likelihood that a chip will have a defective heating element, conductor or other element formed thereon also increases. Thus, manufacturing yields decrease as heater chip size increases.

Accordingly, there is a need for an improved printhead or printhead assembly which allows for increased printing speed yet is capable of being manufactured in an economical manner.

SUMMARY OF THE INVENTION

In accordance with the present invention, a heater chip module is provided comprising a carrier adapted to be secured to an ink-filled container, at least one heater chip having a base coupled to the carrier, and at least one nozzle plate coupled to the heater chip. The carrier includes a support section provided with two or more channels which define paths for ink to travel from the container to the heater chip. The heater chip is secured at its base to the support section. Support section material located between the channels define ribs which provide a path for energy in the form of heat to travel from the heater chip to the carrier. The ribs allow for improved heat transfer away from the heater chip. This is advantageous as heater chips need to be maintained within a reasonably small temperature range for proper operation. A flexible circuit is coupled to the heater chip module such as by TAB bonding or wire bonding.

Two or more heater chips, positioned end to end or at an angle to one another, may be secured to a single carrier. Thus, two or more smaller heater chips can be combined to create the effect of a single, larger heater chip. That is, two or more smaller heater chips can create a data swath that is essentially equivalent to one printed by a substantially larger heater chip.

The carrier support section is preferably formed from a material having substantially the same coefficient of thermal expansion as the heater chip base. Thus, the heater chip base and the support section expand and contract at essentially the same rate. This is advantageous for a number of reasons. First, it is less likely that bonding material joining the heater chip to the carrier will fail. Further, if two or more heater chips are secured to the carrier, accuracy of dot placement is increased as the location of the heater chips relative to the paper is less likely to vary. It is also preferred that the support section be formed from a material having a thermal conductivity which is substantially the same as or greater than the thermal conductivity of the material from which the heater chip base is formed. Hence, the carrier provides a dissipation path for heat generated by the heater chip. Consequently, heat build up in the heater chip, which might occur if the thermal conductivity of the support section is less than that of the heater chip base, is avoided.

DETAILED DESCRIPTION OF PREFERRED EMBODIMENTS

Figure 1:
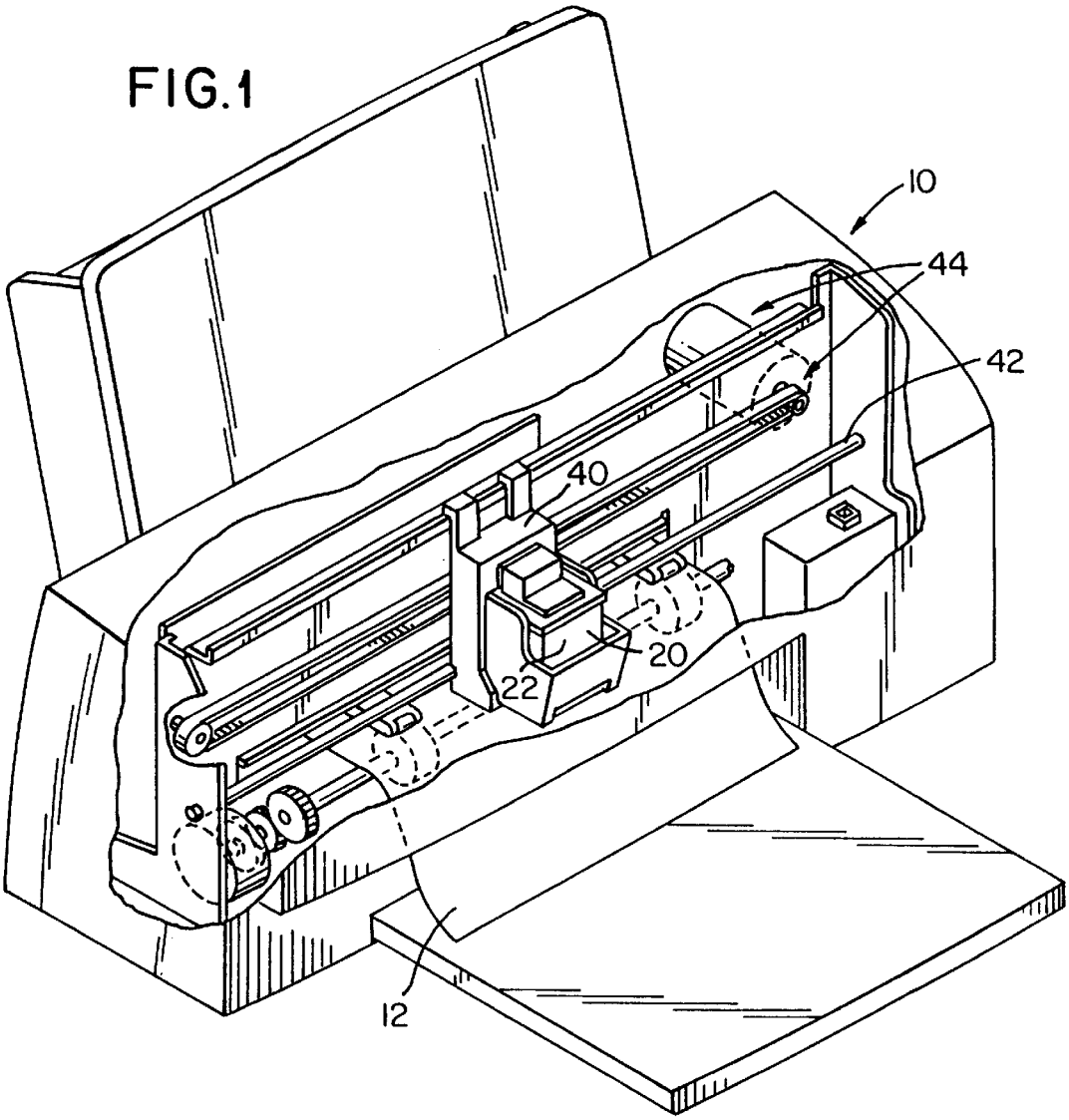
FIG. 1 is a perspective view, partially broken away, of an ink jet printing apparatus having a print cartridge constructed in accordance with the present invention.

Referring now to FIG. 1, there is shown an ink jet printing apparatus 10 having a print cartridge 20 constructed in accordance with the present invention. The cartridge 20 is supported in a carriage 40 which, in turn, is slidably supported on a guide rail 42. A drive mechanism 44 is provided for effecting reciprocating movement of the carriage 40 and the print cartridge 20 back and forth along the guide rail 42. As the print cartridge 20 moves back and forth, it ejects ink droplets onto a paper substrate 12 provided below it.

Figure 2:
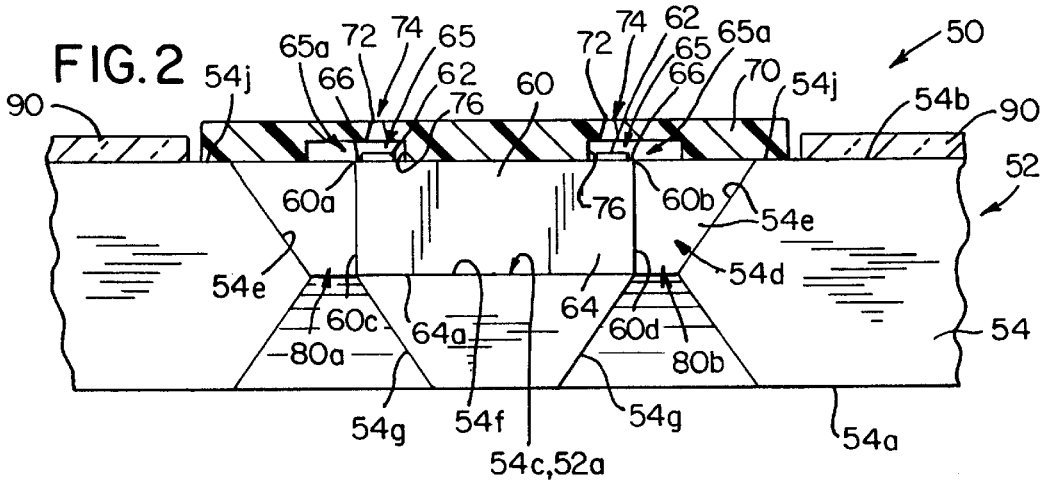
FIG. 2 is a sectional view of a heater chip module constructed in accordance with a first embodiment of the present invention.
Figure 4:
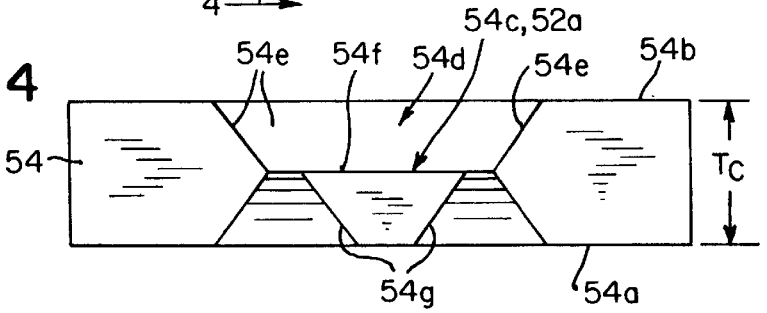
FIG. 4 is a view taken along view line 4—4 in FIG. 3.
Figure 5:
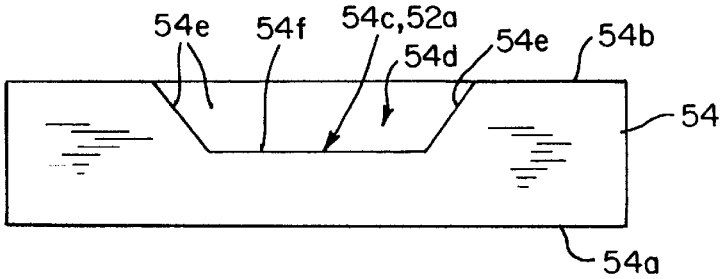
FIG. 5 is a view taken along view line 5—5 in FIG. 3.

The print cartridge 20 comprises a container 22, shown only in FIG. 1, filled with ink and a heater chip module 50, shown in FIG. 2. The container 22 may be formed from a polymeric material. In the illustrated embodiment, the container 22 is formed from polyphenylene oxide, which is commercially available from the General Electric Company under the trademark "NORYL SE-1." The container 22 may be formed from other materials not explicitly set out herein.

In the embodiment illustrated in FIG. 2, the module 50 comprises a carrier 52, an edge-feed heater chip 60 and a nozzle plate 70. The heater chip 60 includes a plurality of resistive heating elements 62 which are located on a base 64. In the illustrated embodiment, the base 64 is formed from silicon. The nozzle plate 70 has a plurality of openings 72 extending through it which define a plurality of nozzles 74 through which ink droplets are ejected. The carrier 52 is secured to a bottom side (not shown) of the container 22, i.e., the side in FIG. 1 closest to the paper substrate 12, such as by an adhesive (not shown). An example adhesive which may be used for securing the carrier 52 to the container 22 is one which is commercially available from Emerson and Cuming Specialty Polymers, a division of National Starch and Chemical Company under the product designation "ECCOBOND 3193-17."

The nozzle plate 70 may be formed from a flexible polymeric material substrate which is adhered to the heater chip 60 via an adhesive (not shown). Examples of polymeric materials from which the nozzle plate 70 may be formed and adhesives for securing the plate 70 to the heater chip 60 are set out in commonly assigned patent application, U.S. Ser. No. 08/966,281, entitled "METHOD OF FORMING AN INKJET PRINTHEAD NOZZLE STRUCTURE," by Ashok Murthy et al., filed on Nov. 7, 1997, which is a continuation-in-part application of patent application, U.S. Ser. No. 08/519,906, entitled "METHOD OF FORMING AN INKJET PRINTHEAD NOZZLE STRUCTURE," by Tonya H. Jackson et al., filed on Aug. 28, 1995, the disclosures of which are hereby incorporated by reference. As noted therein, the plate 70 may be formed from a polymeric material such as polyimide, polyester, fluorocarbon polymer, or polycarbonate, which is preferably about 15 to about 200 microns thick, and most preferably about 20 to about 80 microns thick. Examples of commercially available nozzle plate materials include a polyimide material available from E.I. DuPont de Nemours & Co. under the trademark "KAPTON" and a polyimide material available from Ube (of Japan) under the trademark "UPILEX." The adhesive for securing the plate 70 to the heater chip 60 may comprise a phenolic butyral adhesive. A polyimide substrate/phenolic butyral adhesive composite material is commercially available from Rogers Corporation, Chandler, AZ, under the product name "RFLEX 1100."

The nozzle plate 70 may be bonded to the chip 60 via any technique recognized by someone skilled in the art, including a thermocompression bonding process. When the plate 70 and the heater chip 60 are joined together, sections 76 of the plate 70 and portions 66 of the heater chip 60 define a plurality of bubble chambers 65. Ink supplied by the container 22 flows into the bubble chambers 65 through ink supply channels 65*a*.

As is illustrated in FIG. 2, the supply channels 65*a* extend from the bubble chambers 65 beyond first and second outer edges 60*a* and 60*b* of the heater chip 60. The resistive heating elements 62 are positioned on the heater chip 60 such that each bubble chamber 65 has only one heating element 62. Each bubble chamber 65 communicates with one nozzle 74.

In the embodiment illustrated in FIGS. 2–5, the carrier 52 comprises a single layer silicon substrate 54 having first and second outer surfaces 54*a* and 54*b*, a substrate portion 54*c* and an inner cavity 54*d*. The inner cavity 54*d* is defined by angled inner side walls 54*e* and an upper surface 54*f* of the substrate portion 54*c*. The substrate portion 54*c* defines a carrier support section 52*a* to which the heater chip 60 is secured, see FIG. 2. The portion 54*c* includes a plurality of channels 54*g*, six in the illustrated embodiment, extending from the first outer surface 54*a* of the silicon substrate 54 to the inner cavity 54*d*. Hence, the channels 54*g* communicate with the inner cavity 54*d* so as to define paths for ink to travel from the container 22 to the inner cavity 54*d*. From the inner cavity 54*d*, the ink flows into the ink supply channels 65*a*.

Substrate material located between the channels 54*g* defines ribs or intermediate sections 55 which provide a path for energy in the form of heat to travel from the heater chip 60 to the carrier 52. The ribs 55 allow for improved heat transfer away from the heater chip 60. This is advantageous as heater chips 60 need to be maintained within a reasonably small temperature range for proper operation.

It is further contemplated that two or more inner cavities 54*d* and a like number of substrate portions 54*c* may be formed in a single carrier 52 such that the single carrier 52 is capable of receiving two or more heater chips 60. It is also contemplated that two or more heater chips 60 may be provided in a single inner cavity 54*d* and secured to a single substrate portion 54*c*. In either of the two alternative embodiments, the heater chips 60 may be positioned side by side, end to end or at an angle to one another.

The single layer substrate 54 has a thickness Tc of from about 400 microns to about 5000 microns and, preferably, from about 800 microns to about 2000 microns. The channels 54*g* are generally shaped like a truncated pyramid and converge inwardly from the first outer surface 54*a* to the inner cavity 54*d*. Further, they are generally rectangular where they meet the first outer surface 54*a* and the inner cavity 54*d*. Alternatively, the channels 54*g* may be cylindrical or have another geometric shape. Further, less than six or more than six channels 54*g* may be provided.

It is also contemplated that the single layer substrate 54 and/or the heater chip base 64 may be formed from a material selected from group consisting of ceramics, metals, silicon and polymers. However, it is preferred that the substrate 54 be formed from a material having substantially the same coefficient of thermal expansion as the heater chip base 64 such that the heater chip base 64 and the support section 52*a* expand and contract at essentially the same rate. It is also preferred that the support section 52*a* be formed from a material having a thermal conductivity which is substantially the same as or greater than the thermal conductivity of the material from which the heater chip base 64 is formed so that the carrier 52 provides a dissipation path for heat generated by the heater chip 60. In the illustrated embodiment, the heater chip base 64 and the carrier 52 are formed from silicon.

Figure 3:
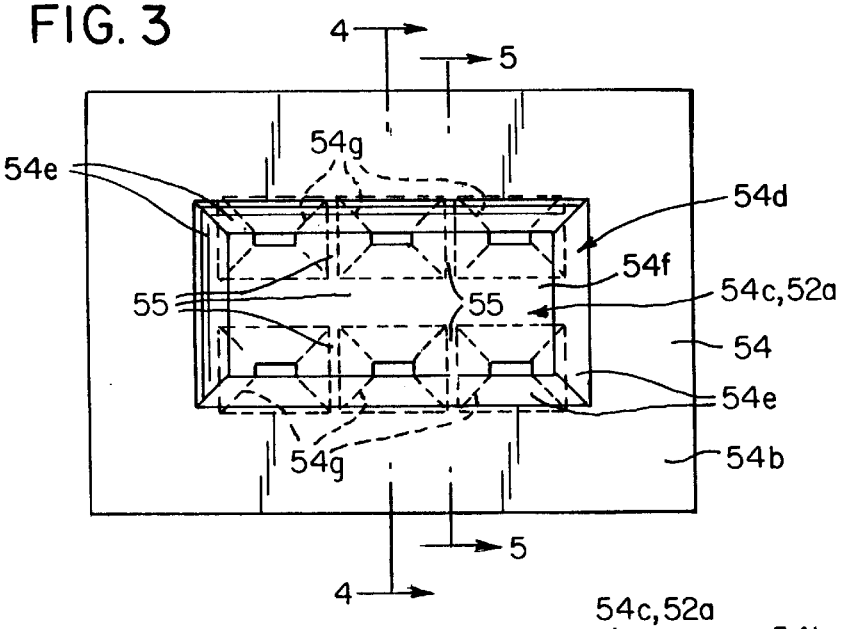
FIG. 3 is a plan view of a single layer substrate of the module illustrated in FIG. 2 with the heater chip and nozzle plate removed.
Figure 3A:
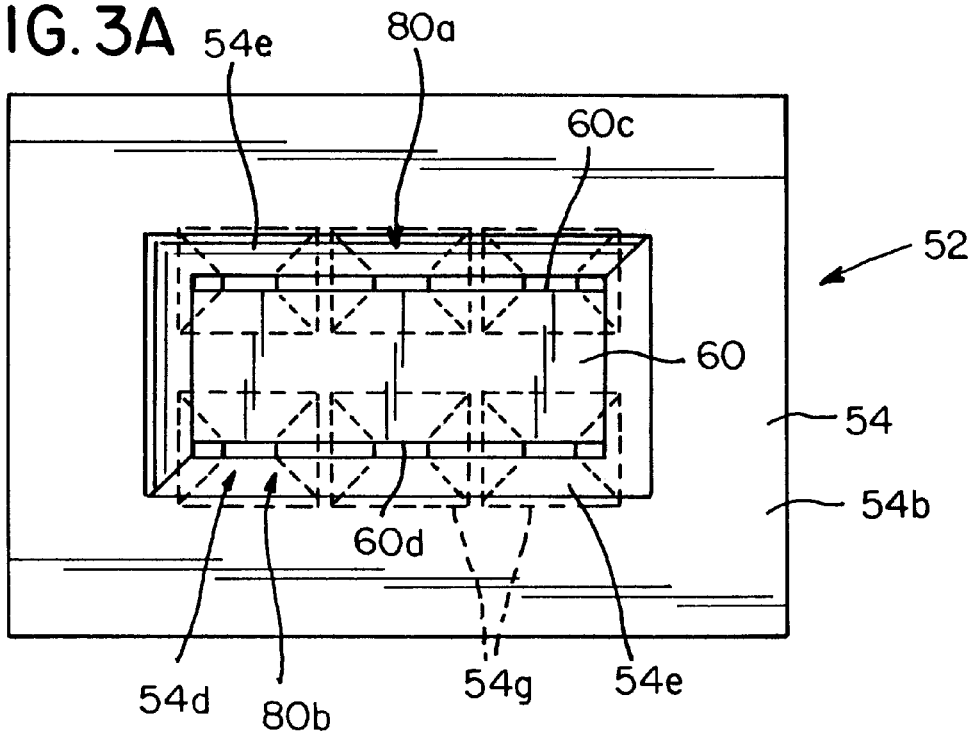
FIG. 3A is a plan view of the single layer substrate and heater chip of the module illustrated in FIG. 1 with the nozzle plate removed.

The inner cavity 54*d* and the heater chip 60 are sized such that opposing side portions 60*c* and 60*d* of the heater chip 60 are spaced from adjacent inner side walls 54*e* of the single layer substrate 54 to form gaps 80*a* and 80*b* of sufficient size to permit ink to flow freely between the chip side portions 60*c* and 60*d* and the adjacent inner side walls 54*e*, see FIG. 3A.

The nozzle plate 70 is sized to extend over an outer portion 54*j* of the single layer substrate 54 surrounding the inner cavity 54*d* such that the inner cavity 54*d* is sealed to prevent ink from leaking from the cavity 54*d*. As noted above, the channels 54*g* provide paths for ink to travel from the container 22 to the inner cavity 54*d*. From the inner cavity 54*d*, the ink flows into the ink supply channels 65*a*.

The resistive heating elements 62 are individually addressed by voltage pulses provided by a printer energy supply circuit (not shown). Each voltage pulse is applied to one of the heating elements 62 to momentarily vaporize the ink in contact with that heating element 62 to form a bubble within the bubble chamber 65 in which the heating element 62 is located. The function of the bubble is to displace ink within the bubble chamber 65 such that a droplet of ink is expelled from a nozzle 74 associated with the bubble chamber 65.

A flexible circuit 90, secured to the polymeric container 22 and the single layer substrate 54, is used to provide a path for energy pulses to travel from the printer energy supply circuit to the heater chip 60. Bond pads (not shown) on the heater chip are wire-bonded to sections (not shown) of traces (not shown) on the flexible circuit 90. Current flows from the printer energy supply circuit to the traces on the flexible circuit 90 and from the traces to the bond pads on the heater chip 60. Conductors (not shown) are formed on the heater chip base 64 and extend from the bond pads to the heating elements 62. The current flows from the bond pads along the conductors to the heating elements 62. The process for forming the single layer silicon substrate 54 will now be described with reference to FIGS. 6A–6E. A silicon wafer 154 (also referred to herein as a silicon plate) having a thickness $T_C$ of from about 400 microns to about 5000 microns and preferably from about 800 microns to about 2000 microns is provided. The thickness of the wafer 154 is not critical and may fall outside of this range. A plurality of single layer substrates 54 are formed on a single wafer 154. For ease of illustration, only a portion of the wafer 154 is illustrated in FIGS. 6A–6E.

Figure 6A:
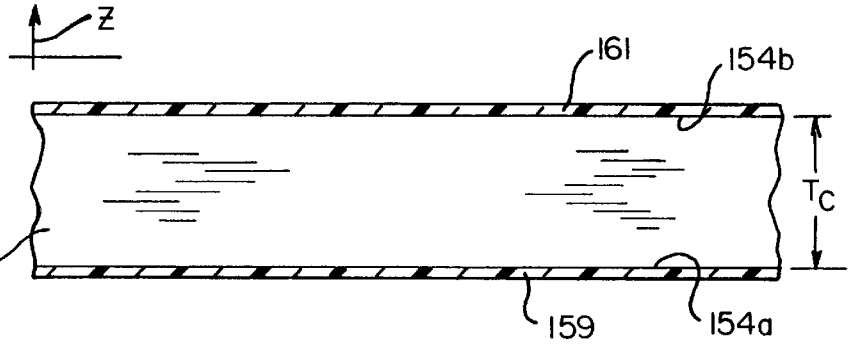
FIGS. 6A–6E are schematic cross sectional views illustrating the process for forming the single layer substrate illustrated in FIGS. 2–5.
Figure 6B:
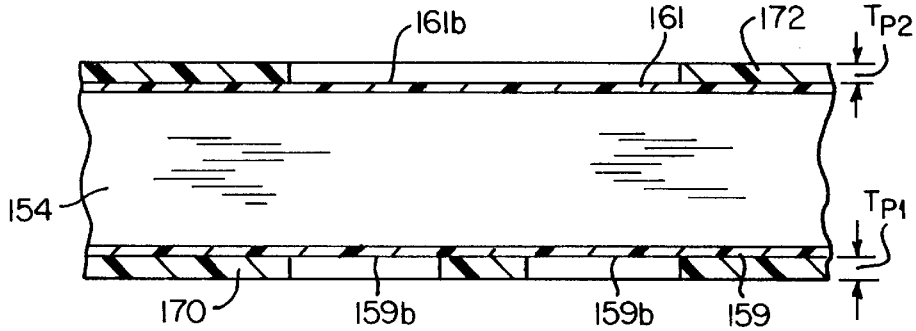

First and second etch resistant material layers 159 and 161 are formed on first and second sides 154*a* and 154*b* of the wafer 154, see FIG. 6A. The layers 159 and 161 may be formed from any one of a number of known etch resistant materials including, for example, silicon nitride, silicon carbide, aluminum, tantalum, silicon dioxide, and the like. In the illustrated embodiment, silicon nitride is deposited simultaneously onto the outer surfaces of the wafer 154 using a conventional low-pressure vapor deposition process or a plasma enhanced chemical vapor deposition process. Alternatively, silicon dioxide layers may be thermally grown on the wafer 154, or aluminum or tantalum layers may be formed on the opposing wafer surfaces via a conventional sputter or evaporation process.

The first layer 159 has a thickness in the Z-direction, see FIG. 6A, of from about 1.0 micron to about 20 microns, and preferably from about 1.0 micron to about 2.5 microns. The second layer 161 has a thickness in the Z-direction of from about 1.0 micron to about 20 microns, and preferably from about 1.0 micron to about 2.5 microns.

After the first and second layers 159 and 161 are deposited onto the wafer 154, a first photoresist layer 170 is formed over the first etch resistant material layer 159 via a conventional spinning process. The layer 170 has a thickness $T_{P1}$ of from about 100 angstroms to about 50 microns, and preferably from about 1.0 micron to about 5.0 microns. The photoresist material may be a negative or a positive photoresist material. In the illustrated embodiment, the layer 170 is formed from a negative photoresist material which is commercially available from Olin Microelectronic Materials under the product designation "SC-100 Resist." After the photoresist layer 170 is spun onto the wafer 154, it is softbaked at an appropriate temperature so as to partially evaporate photoresist solvents to promote adhesion of the layer 170 to the first layer 159. A further reason for softbaking the layer 170 is to prevent a first mask, to be discussed below, from adhering to the layer 170.

Figure 6C:
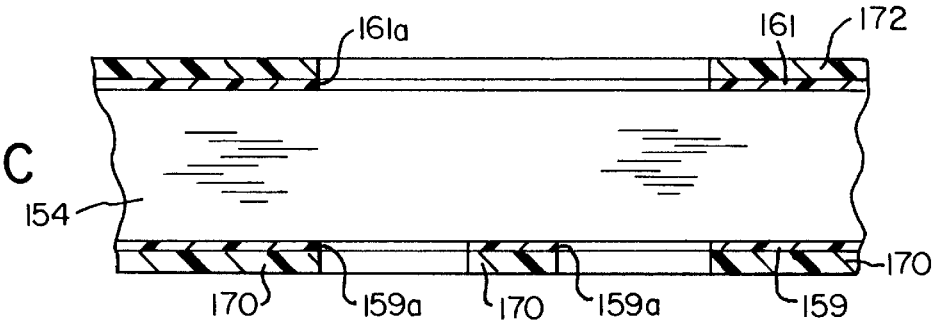
Figure 6D:
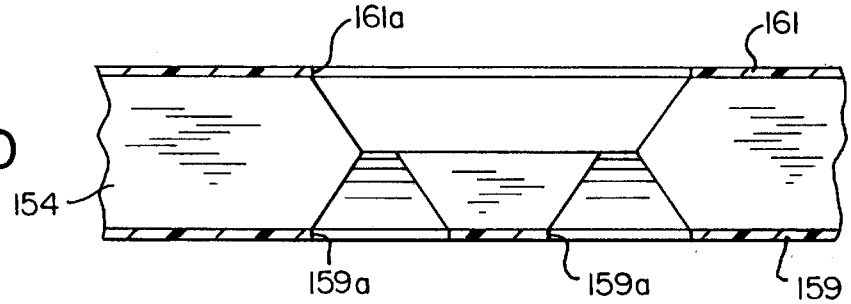
Figure 6E:
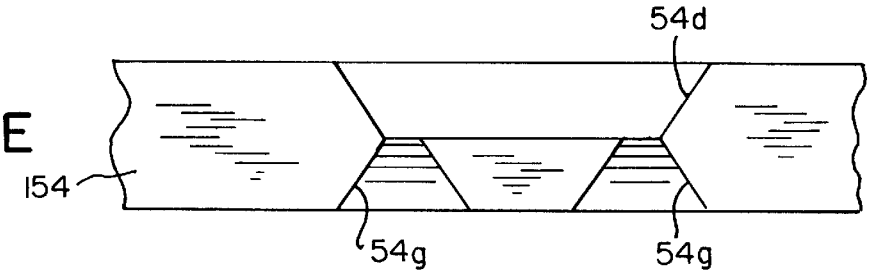

A first mask (not shown), having a plurality of blocked or covered areas which s correspond to first openings 159*a* in the first layer 159, see FIG. 6C, is positioned over the first photoresist layer 170. The first mask is aligned in a conventional manner such as to the wafer flat (not shown). Thereafter, unblocked portions of the first photoresist layer 170 are exposed to ultraviolet light to effect curing or polymerization of the exposed portions. The first mask is then removed. Thereafter, the unexposed or uncured portions of the first photoresist layer 170 are removed using a conventional developer chemical. In the illustrated embodiment, the unpolymerized portions are removed by spraying a developer, such as one which is commercially available from Olin Microelectronic Materials under the product designation "PF developer," onto the first wafer side while the wafer 154 is spinning. After the development process has been initiated, a mixture of about 90% developer chemical and 10% isopropyl alcohol, by volume, is sprayed onto the first side of the spinning wafer 154. Finally, the development process is stopped by spraying only isopropyl alcohol onto the spinning wafer 154. After the unpolymerized portions of the first photoresist layer 170 are removed from the wafer 154, portions 159*b* of the first etch resistant material layer 159 are exposed, see FIG. 6B.

Instead of spraying the three different development compositions onto the wafer 154, the wafer 154 may be sequentially placed in three baths containing, respectively, 100% developer, a mixture of about 90% developer and 10% isopropyl alcohol, and 100% isopropyl alcohol. The wafer 154 remains in the first bath until the development process has been initiated. It is removed from the second bath and placed in the third bath after the unpolymerized portions of the first layer 170 have been removed. The wafer 154 is preferably agitated when in each of the baths.

Next, a second photoresist layer 172 is formed over the second etch resistant material layer 161 via a conventional spinning process. The layer 172 has a thickness $T_{P2}$ of from about 100 angstroms to about 50 microns, and preferably from about 1.0 micron to about 5.0 microns. The second photoresist material may be a negative or a positive photoresist material. In the illustrated embodiment, the layer 172 is formed from a negative photoresist material which is commercially available from Olin Microelectronic Materials under the product designation "SC-100 Resist." After the photoresist layer 172 is spun onto the wafer 154, it is softbaked at an appropriate temperature so as to partially evaporate photoresist solvents to promote adhesion of the layer 172 to the second layer 161. A further reason for softbaking the layer 172 is to prevent a second mask, to be discussed below, from adhering to the layer 172.

A second mask (not shown), having a plurality of blocked or covered areas which correspond to one or more second openings 161*a* in the second layer 161, see FIG. 6C, is positioned over the second photoresist layer 172. The second mask is aligned in a conventional manner such as to the wafer flat (not shown). Thereafter, unblocked portions of the second photoresist layer 172 are exposed to ultraviolet light to effect curing or polymerization of the exposed portions. The second mask is then removed. Thereafter, the unexposed or uncured portions of the second photoresist layer 172 are removed in the same manner as the unpolymerized portions of the first photoresist layer 170. As can be seen from FIG. 6B, after the unpolymerized portions of the second photoresist layer 172 are removed from the wafer 154, one or more portions 161*b* of the second etch resistant material layer 161 are exposed.

Following the development of the first and second photoresist layers 170 and 172, the first and second layers 170 and 172 are hardbaked in a conventional manner so as to effect final evaporation of remaining solvents in the layers 170 and 172.

The patterns formed in the first and second photoresist layers 170 and 172 are transferred to the first and second etch resistant material layers 159 and 161, see FIG. 6C, using a conventional etching process. For example, a conventional reactive ion etching process may be used. When the first and second etch resistant material layers 159 and 161 are formed from silicon nitride, the reactive gas supplied to the reactive ion etcher is $CF_4$. For etching of aluminum, a chlorine gas may be supplied. When the layers 159 and 161 are formed from tantalum, a $CF_4$ gas is preferably provided.

After the patterns have been transferred to the first and second etch resistant material layers 159 and 161, the polymerized photoresist material 170 and 172 remaining on the wafer 154 is removed in a conventional manner. For example, a conventional reactive ion etcher receiving an $O_2$ plasma may be used. Alternatively, a commercially available resist stripper such as one which is available from Olin Microelectronic Materials under the product designation "Microstrip" may be used.

Next, a micromachining step is implemented to form the channels 54*g* and the inner cavity 54*d* in the silicon wafer 154. This step involves placing the wafer 154 in an etchant bath such that exposed portions of the silicon are etched away. A tetramethyl ammonium hydroxide (TMAH) based bath may be used. The TMAH based bath comprises, by weight, from about 5% to about 40%, and preferably about 10% tetramethyl animonium hydroxide, and from about 60% to about 95%, and preferably about 90%, water. The TMAH/water solution is passivated by dissolving silicon and/or silicic acid into the TMAH/water solution until the solution has a pH of from about 11 to about 13. A more detail discussion of passivating TMAH solutions can be found in the paper: U. Schnakenberg, W. Benecke, and P. Lange, *THAHW Etchants for Silicon Micromachining*," In Proc. Int. Conf. on Solid State Sensors and Actuators (Transducers 1991), pages 815–818, San Francisco, June 1991, the disclosure of which is incorporated herein by reference. The passivated TMAH/water solution is advantageous as it will not attack a metal etch resistant layer. If the first and second etch resistant material layers 159 and 161 are formed from a non-metal, such as silicon nitride, a potassium hydroxide (KOH) based bath may be used. The KOH bath comprises, by weight, from about 5% to about 75%, and preferably about 45% potassium hydroxide, and from about 25% to about 95%, and preferably about 55% water. Thus, if the first and second etch resistant material layers 159 and 161 are formed from a metal, such as aluminum or tantalum, a tetramethyl ammonium hydroxide (TMAH) based bath should be used as a KOH bath will attack the metal layers 159 and 161. When sufficient etching has occurred such that the channels 54*g* and the inner cavity 54*d* are formed, see FIG. 6D, the wafer 154 is removed from the bath.

Thereafter, the first and second etch resistant material layers 159 and 161 may be removed using a conventional reactive ion etcher. After removal of the first and second layers 159 and 161, the wafer 154 is diced into individual carriers 52. It is also contemplated that the layers 159 and 161 may remain on the wafer 154 such that each carrier 52 includes outer etch resistant layers.

The process for forming the heater chip module 50 illustrated in FIG. 2 will now be described. As noted above, the nozzle plate 70 comprises a flexible polymeric material substrate. In the illustrated embodiment, the flexible substrate is provided with an overlaid layer of phenolic butyral adhesive for securing the nozzle plate 70 to the heater chip 60 and the carrier 52.

Initially, the nozzle plate 70 is aligned with and mounted to the heater chip 60. At this point, the heater chip 60 has been separated from other heater chips 60 formed on the same wafer. Alignment may take place as follows. One or more first fiducials (not shown) may be provided on the nozzle plate 70 which are aligned with one or more second fiducials (not shown) provided on the heater chip 60. After the nozzle plate 70 is aligned to and located on the heater chip 60, the plate 70 is tacked to the heater chip 60 using, for example, a conventional thermocompression bonding process. The phenolic butyral adhesive on the nozzle plate 70 is not cured after the tacking step has been completed.

An adhesive material (not shown), such as a 0.002 inch thick, die-cut phenolic adhesive film, which is commercially available from Rogers Corporation (Chandler, Ariz.) under the product designation "1000B200," is placed on a portion of the carrier 52 to which the flexible circuit 90 is to be secured. Preferably, at this juncture, the carrier 52 has been separated from other carriers formed on the same wafer. After the adhesive film is placed on the carrier, the flexible circuit 90 is positioned over the adhesive film and tacked to the carrier 52 using heat and pressure.

The nozzle plate/heater chip assembly is then mounted to the carrier 52. Initially, 20 a conventional die bond adhesive (not shown), such as a substantially transparent phenolic polymer adhesive which is commercially available from Georgia Pacific under the product designation "BKS 2600," is applied to the upper surface 54*f* of the substrate portion 54*c* at locations where one or more heater chips 60 are to be located. It is contemplated that one or two or more heater chips 60 may be secured to a single carrier 52. For example, two beater chips 60 may be positioned end to end, side by side or offset from one another on the carrier 52. Two heater chips 60 may be provided in the same inner cavity 54*d* or different inner cavities 54*d*. Thereafter, each heater chip 60 is aligned with and mounted to the carrier 52 in a manner such as described in the patent application entitled "AN INK JET HEATER CHIP MODULE," previously incorporated herein by reference.

The nozzle plate/heater chip assembly is tacked to the carrier 52 so as to maintain the assembly and the carrier 52 joined together until the die bond adhesive is cured. Before the nozzle plate/heater chip assembly is mounted to the carrier 52, a conventional ultraviolet (UV) curable adhesive (not shown), such as one which is commercially available from Emerson and Cuming Specialty Polymers, a division of National Starch and Chemical Company under the product designation UV9000, is applied to one or more locations on the carrier 52 where corners of the heater chip 60 are to be located. After the nozzle plate/heater chip assembly is mounted to the carrier 52, exposed UV adhesive is cured using ultraviolet radiation to effect tacking.

Next, the nozzle plate/heater chip assembly and the support substrate/spacer assembly are heated in an oven at a temperature and for a time period sufficient to effect the curing of the following materials: the phenolic butyral adhesive that bonds the nozzle plate 70 to the heater chip 60 and the carrier 52; the phenolic adhesive film which joins the flexible circuit 90 to the carrier 52; and the die bond adhesive which joins the heater chip 60 to the substrate portion 54*c*.

After the nozzle plate/heater chip assembly and the flexible circuit 90 have been is bonded to the carrier 52, sections (not shown) of the traces (not shown) on the flexible circuit 90 are wire-bonded to the bond pads (not shown) on the heater chip 60. It is also contemplated that trace end sections may be coupled to the bond pads via a conventional Tape Automated Bonding (TAB) process. After wire-bonding or TAB bonding, a liquid encapsulant material (not shown), such as an ultraviolet (UV) curable adhesive, one of which is commercially available from Emerson and Cuming Specialty Polymers, a division of National Starch and Chemical Company under the product designation "UV9000," is applied over the trace sections, the bond pads and the wires extending between the trace sections and the bond pads. The UV adhesive is then cured using ultraviolet light.

The heater chip module 50, which comprises the nozzle plate/heater chip assembly and the carrier 52, and to which the flexible circuit 90 is bonded, is aligned with and bonded to a polymeric container 22. An adhesive (not shown) such as one which is commercially available from Emerson and Cuming Specialty Polymers, a division of National Starch and Chemical Company under the product designation "ECCOBOND 3193-17" is applied to a portion of the container where the module 50 is to be located.

The module 50 is then mounted to the container portion.

Next, the heater chip module 50 and container 22 are heated in an oven at a temperature and for a time period sufficient to effect the curing of the adhesive which joins the module 50 to the container 22.

A portion of the flexible circuit 90 which is not joined to the carrier 52 is bonded to the container 22 by, for example, a conventional free-standing pressure sensitive adhesive film, such as described in copending patent application U.S. Ser. No. 08/827,140, entitled "A PROCESS FOR JOINING A FLEXIBLE CIRCUIT TO A POLYMERIC CONTAINER AND FOR FORMING A BARRIER LAYER OVER SECTIONS OF THE FLEXIBLE CIRCUIT AND OTHER ELEMENTS USING AN ENCAPSULANT MATERIAL," filed Mar. 27, 1997, the disclosure of which is incorporated herein by reference.

It is also contemplated that the heater chip 60 may be secured to the carrier 52 by silicon fusion bonding, eutectic bonding, or anodic bonding.

Figure 7:
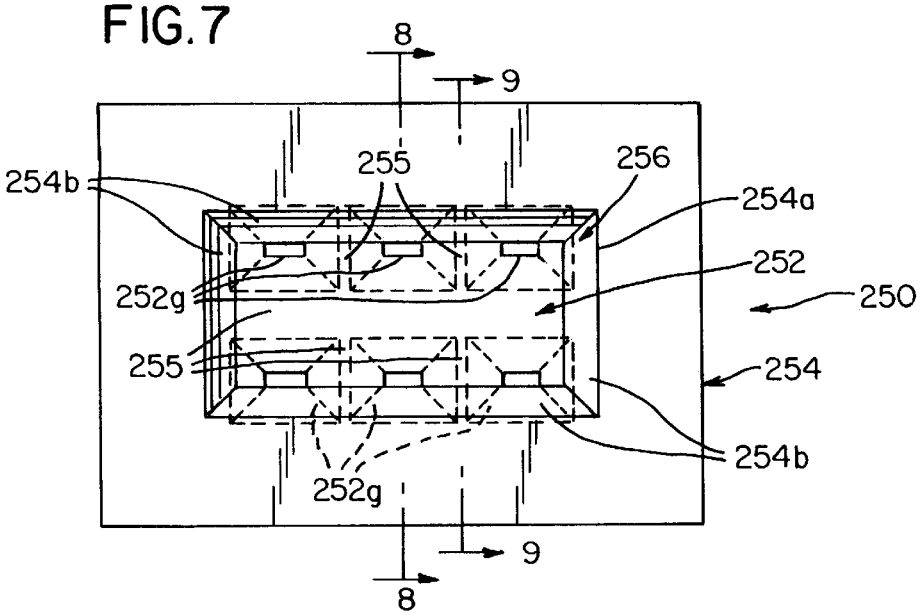
FIG. 7 is a plan view of a chip carrier formed in accordance with a second embodiment of the present invention.
Figure 8:
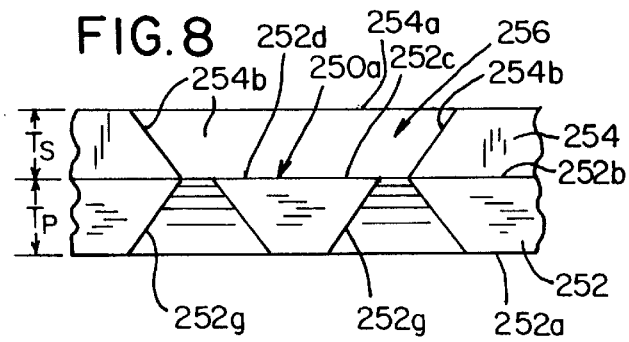
FIG. 8 is a view taken along view line 8—8 in FIG. 7.
Figure 9:
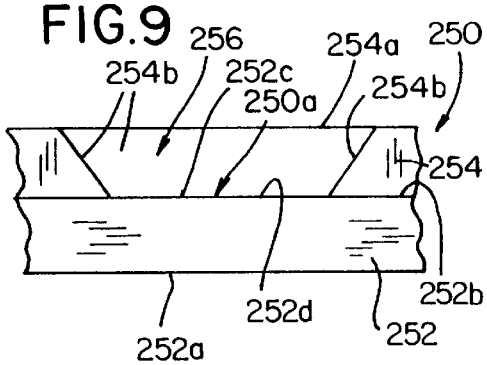
FIG. 9 is a view taken along view line 9—9 in FIG. 7.
Figure 10:
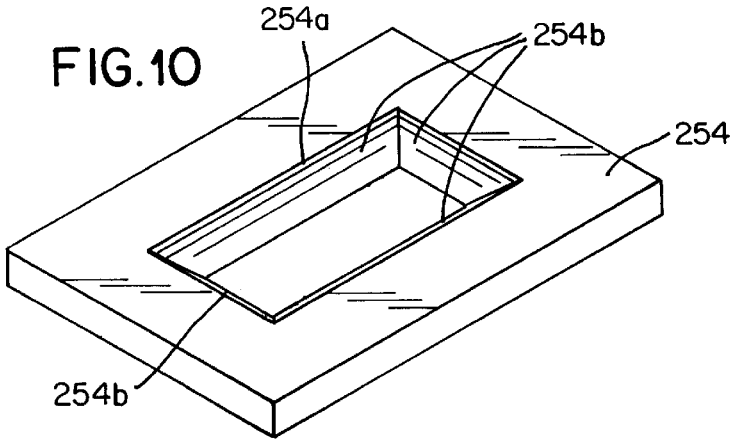
FIG. 10 is a perspective view of the spacer of the chip carrier illustrated in FIG. 7.

A carrier 250, formed in accordance with a second embodiment of the present invention, is shown in FIGS. 7–9. Here, the carrier 250 comprises a support substrate 252 and a spacer 254 secured to the support substrate 252. The spacer 254 has a generally rectangular opening 254*a* defined by sloping inner side walls 254*b*. The support substrate 252 has first and second outer surfaces 252*a* and 252*b* and a portion 252*c* which defines a carrier support section 250*a* to which an edge feed heater chip (not shown), such as chip 60 shown in FIG. 1, is secured. An upper surface 252*d* of the support substrate portion 252*c* and the inner side walls 254*b* of the spacer 254 define an inner cavity 256 of the carrier 250. The edge feed heater chip is located in the carrier inner cavity 256 and secured to the carrier support section 250*a*. The support substrate 252 has a thickness $T_P$ of from about 400 microns to about 2500 microns and, preferably, from about 500 microns to about 1000 microns. The spacer 254 has a thickness $T_S$ of from about 400 microns to about 2500 microns and, preferably, from about 500 microns to about 1000 microns.

The portion 252*c* includes a plurality of channels 252*g*, six in the illustrated embodiment, extending from the first outer surface 252*a* of the support substrate 252 to the inner cavity 256. Hence, the channels 252*g* communicate with the inner cavity 256 so as to define paths for ink to travel from the container 22 to the inner cavity 256. From the inner cavity 256, the ink flows into ink supply channels 65*a* of a nozzle plate/heater chip assembly.

The channels 252*g* are generally shaped like a truncated pyramid and converge inwardly from the first outer surface 252*a* to the inner cavity 256. Further, they are generally rectangular where they meet the first outer surface 252*a* and the inner cavity 256. Alternatively, the channels 252*g* may be cylindrical or have another geometric shape. Further, less than six or more than six channels 252*g* may be provided.

Substrate material located between the channels 252*g* define ribs or intermediate sections 255 which provide a path for energy in the form of heat to travel from the heater chip 60 to the carrier 250.

The spacer 254 and the support substrate 252 may be formed from a material selected from the group consisting of ceramics, metals, silicon, and polymers. It is preferred that the support substrate 252 be formed from a material having substantially the same coefficient of thermal expansion as the base of the heater chip base such that the heater chip base and the support substrate 252 expand and contract at essentially the same rate. It is also preferred that the support substrate 252 be formed from a material having a thermal conductivity which is substantially the same as or greater than the thermal conductivity of the material from which the heater chip base is formed so that the carrier 250 provides a dissipation path for heat generated by the heater chip. In the illustrated 20 embodiment, spacer 254 and the support substrate 252 are formed from silicon.

The spacer 254 is secured to the support substrate 252 by an adhesive (not shown).

Example adhesives which may be used for securing the spacer 254 to the support substrate 252 include a thermally curable B-stage adhesive (polysulfone) film preform which is commercially available from Alpha Metals Inc. under the product designation "Staystik 415" and another adhesive material which is commercially available from Mitsui Toatsu Chemicals Inc. under the product designation "REGULUS." The process for forming the spacer 254 will now be described with reference to FIGS. 12A–12E. A silicon wafer 354 having a thickness $T_S$ of from about 400 microns to about 2500 microns and preferably from about 500 microns to about 1000 microns is provided. The thickness of the wafer 354 is not critical and may fall outside of this range.

A plurality of spacers 254 are formed on a single wafer 354. For ease of illustration, only a portion of the wafer 354 is illustrated in FIGS. 12A–12E.

Figure 12A:
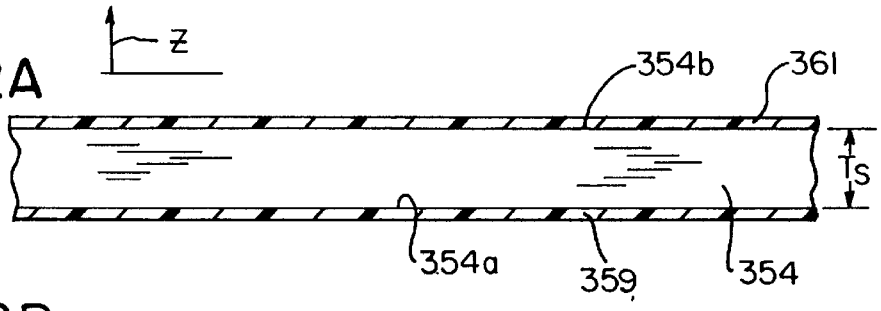
FIGS. 12A–12E are schematic cross sectional views illustrating the process for forming the spacer illustrated in FIG. 7.
Figure 12B:
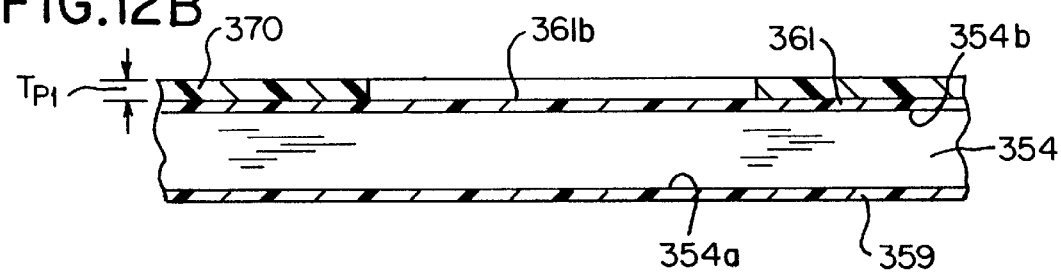

First and second etch resistant material layers 359 and 361 are formed on first and second sides 354*a* and 354*b* of the wafer 354, see FIG. 12A. The layers 359 and 361 may be formed from any one of a number of known etch resistant materials including, for example, silicon nitride, silicon carbide, aluminum, tantalum, silicon dioxide, and the like. In the illustrated embodiment, silicon nitride is deposited simultaneously onto the outer surfaces of the wafer 354 using a conventional low-pressure vapor deposition process or a plasma enhanced chemical vapor deposition process. Alternatively, silicon dioxide layers may be thermally grown on the wafer 354, or aluminum or tantalum layers may be formed on the opposing wafer surfaces via a conventional sputter or evaporation process.

The first layer 359 has a thickness in the Z-direction, see FIG. 12A, of from about 1.0 micron to about 20 microns, and preferably from about 1.0 micron to about 2.5 microns. The second layer 361 has a thickness in the Z-direction of from about 1.0 micron to about 20 microns, and preferably from about 1.0 micron to about 2.5 microns.

After the first and second layers 359 and 361 are deposited onto the wafer 354, a first photoresist layer 370 is formed over the second etch resistant material layer 361 via a conventional spinning process. The layer 370 has a thickness $T_{P1}$ of from about 100 angstroms to about 50 microns, and preferably from about 1.0 micron to about 5.0 microns. The photoresist material may be a negative or a positive photoresist material. In the illustrated embodiment, the layer 370 is formed from a negative photoresist material which is commercially available from Olin Microelectronic Materials under the product designation "SC-100 Resist." After the photoresist layer 370 is spun onto the wafer 354, it is softbaked at an appropriate temperature so as to partially evaporate photoresist solvents to promote adhesion of the layer 370 to the second layer 361.

Figure 12C:
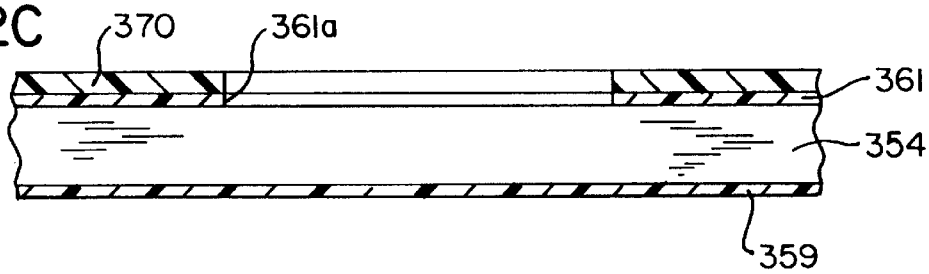
Figure 12D:
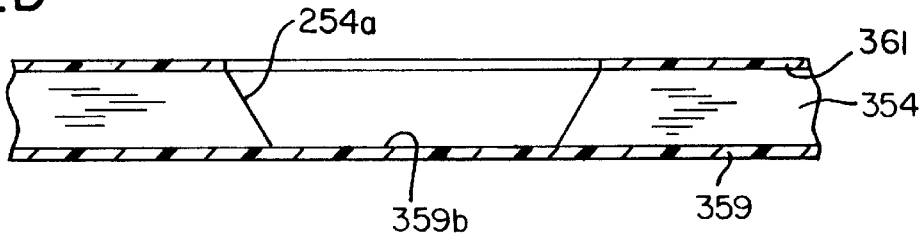
Figure 12E:
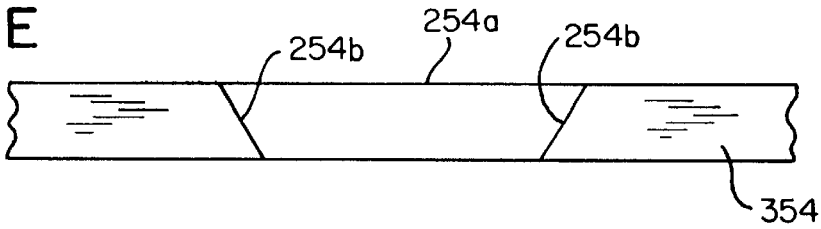

A first mask (not shown), having a plurality of blocked or covered areas which correspond to one or more first openings 361*a* in the second layer 361, see FIG. 12C, is positioned over the first photoresist layer 370. The first mask is aligned in a conventional manner such as to the wafer flat (not shown). Thereafter, unblocked portions of the first photoresist layer 370 are exposed to ultraviolet light to effect curing or polymerization of the exposed portions. The first mask is then removed. Thereafter, the unexposed or uncured portions of the first photoresist layer 370 are removed in the same manner as the unpolymerized portions of the first photoresist layer 170, as described above. After the unpolymerized portions of the first photoresist layer 370 are removed from the wafer 354, portions 361*b* of the second etch resistant material layer 361 are exposed, see FIG. 12B.

Following the development of the first photoresist layer 370, the first layer 370 is hardbaked in a conventional manner so as to effect final evaporation of remaining solvents in the layer 370.

The pattern formed in the first photoresist layer 370 is transferred to the second etch resistant material layer 361, see FIG. 12C, using a conventional etching process. For example, a conventional reactive ion etching process may be used. When the second etch resistant material layer 361 is formed from silicon nitride, the reactive gas supplied to the reactive ion etcher is $CF_4$. For etching of aluminum, a chlorine gas may be supplied.

When the layer 361 is formed from tantalum, a $CF_4$ gas is preferably provided.

After the pattern has been transferred to the second etch resistant material layer 361, the polymerized photoresist material remaining on the wafer 354 is removed in a conventional manner. For example, a conventional reactive ion etcher receiving an $O_2$ is plasma may be used. Alternatively, a commercially available resist stripper such as one which is available from Olin Microelectronic Materials under the product designation "Microstrip" may be used.

Next, a micromachining step is implemented to form the one or more openings 254*a* in the silicon wafer 354. This step involves placing the wafer 354 in an etchant bath such that exposed portions of the silicon are etched away. The etching step is performed in essentially the same manner as the one described above for forming the channels 54*g* and the inner cavity 54*d* in the silicon wafer 154. When sufficient etching has occurred such that the one or more openings 254*a* are formed, see FIG. 12D, the wafer 354 is removed from the bath.

Thereafter, the first and second etch resistant material layers 359 and 361 are removed using a conventional reactive ion etcher. Alternatively, only sections 359*b* of the layer 359 may be removed during a wafer washing step using a conventional wafer washer. After removal of the first and second layers 359 and 361 or sections 359*b* of the first layer 359, the wafer 354 is diced into individual spacers 254.

The process for forming the support substrate 252 will now be described with reference to FIGS. 13A–13E. A silicon wafer 454 having a thickness $T_P$ of from about 400 microns to about 2500 microns and preferably from about 500 microns to about 1000 microns is provided. The thickness of the wafer 454 is not critical and may fall outside of this range. A plurality of support substrates 252 are formed on a single wafer 454. For ease of illustration, only a portion of the wafer 454 is illustrated in FIGS. 13A–13E.

Figure 13A:
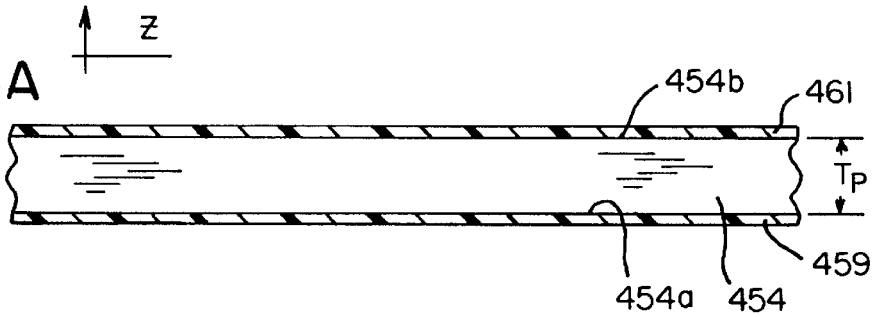
FIGS. 13A–13E are schematic cross sectional views illustrating the process for forming the support substrate illustrated in FIG. 7.
Figure 13B:
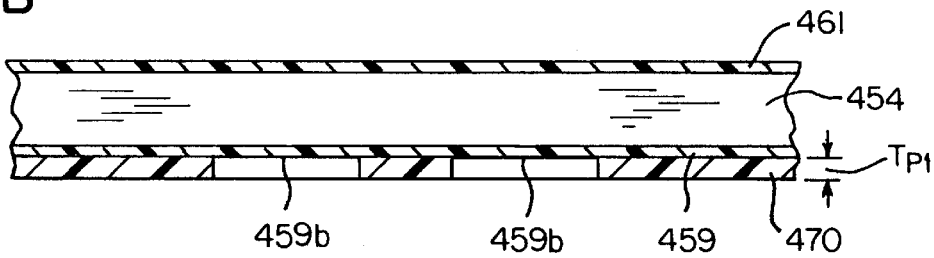

First and second etch resistant material layers 459 and 461 are formed on first and second sides 454*a* and 454*b* of the wafer 454, see FIG. 13A. The layers 459 and 461 may be formed from any one of a number of known etch resistant materials including, for example, silicon nitride, silicon carbide, aluminum, tantalum, silicon dioxide, and the like. In the illustrated embodiment, silicon nitride is deposited simultaneously onto the outer surfaces of the wafer 454 using a conventional low-pressure vapor deposition process or a plasma enhanced chemical vapor deposition process. Alternatively, silicon dioxide layers may be thermally grown on the wafer 454, or aluminum or tantalum layers may be formed on the opposing wafer surfaces via a conventional sputter or evaporation process.

The first layer 459 has a thickness in the Z-direction, see FIG. 13A, of from about 1.0 micron to about 20 microns, and preferably from about 1.0 micron to about 2.5 microns. The second layer 461 has a thickness in the Z-direction of from about 1.0 micron to about 20 microns, and preferably from about 1.0 micron to about 2.5 microns.

After the first and second layers 459 and 461 are deposited onto the wafer 454, a first photoresist layer 470 is formed over the first etch resistant material layer 459 via a conventional spinning process. The layer 470 has a thickness $T_{P1}$ of from about 100 angstroms to about 50 microns, and preferably from about 1.0 micron to about 5.0 microns. The photoresist material may be a negative or a positive photoresist material. In the illustrated embodiment, the layer 470 is formed from a negative photoresist material which is commercially available from Olin Microelectronic Materials under the product designation "SC-100 Resist." After the photoresist layer 470 is spun onto the wafer 454, it is softbaked at an appropriate temperature so as to partially evaporate photoresist solvents to promote adhesion of the layer 470 to the first layer 459. A further reason for softbaking the layer 470 is to prevent a first mask, to be discussed below, from adhering to the layer 470.

Figure 13C:
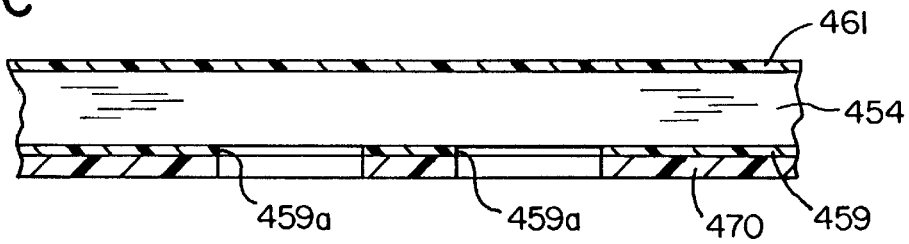
Figure 13D:
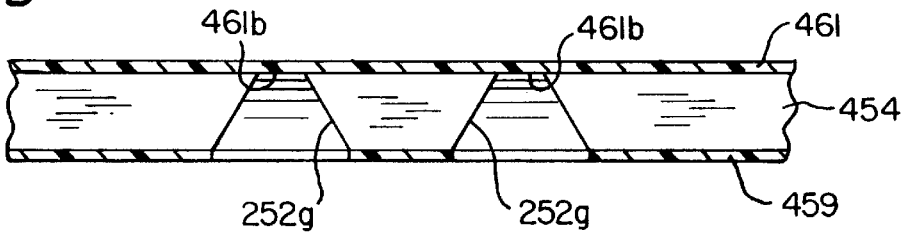
Figure 13E:
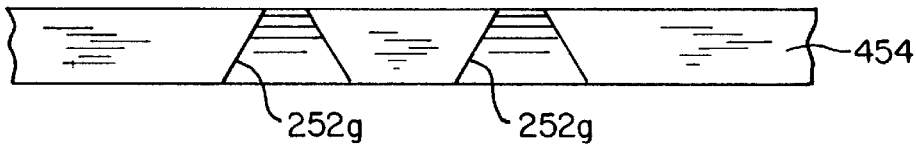

A first mask (not shown), having a plurality of blocked or covered areas which correspond to first openings 459*a* in the first layer 459, see FIG. 13C, is positioned over the first photoresist layer 470. The first mask is aligned in a conventional manner such as to the wafer flat (not shown). Thereafter, unblocked portions of the first photoresist layer 470 are exposed to ultraviolet light to effect curing or polymerization of the exposed portions. The first mask is then removed. Thereafter, the unexposed or uncured portions of the first photoresist layer 470 are removed in the same manner as the unpolymerized portions of the first photoresist layer 170, as described above. After the unpolymerized portions of the first photoresist layer 470 are removed from the wafer 454, portions 459*b* of the first etch resistant material layer 459 are exposed, see FIG. 13B.

Following the development of the first photoresist layer 470, the first layer 470 is hardbaked in a conventional manner so as to effect final evaporation of remaining solvents in the layer 470.

The pattern formed in the first photoresist layers 470 is transferred to the first etch resistant material layer 459, see FIG. 13C, using a conventional etching process. For example, a conventional reactive ion etching process may be used. When the first etch resistant material layer 459 is formed from silicon nitride, the reactive gas supplied to the reactive ion etcher is $CF_4$ For etching of aluminum, a chlorine gas may be supplied. When the layer 459 is formed from tantalum, a $CF_4$ gas is preferably provided.

After the pattern has been transferred to the first etch resistant material layer 459, the polymerized photoresist material remaining on the wafer 454 is removed in a conventional manner. For example, a conventional reactive ion etcher receiving an $O_2$ plasma may be used. Alternatively, a commercially available resist stripper such as one which is available from Olin Microelectronic Materials under the product designation "Microstrip" may be used.

Next, a micromachining step is implemented to form the channels 252*g* in the silicon wafer 454. This step involves placing the wafer 454 in an etchant bath such that exposed portions of the silicon are etched away. The etching step is performed in essentially the same manner as the one described above for forming the channels 54*g* and the inner cavity 54*d* in the silicon wafer 154. When sufficient etching has occurred such that the channels 252*g* are formed, see FIG. 13D, the wafer 454 is removed from the bath.

Thereafter, the first and second etch resistant material layers 459 and 461 are removed using a conventional reactive ion etcher. Alternatively, only sections 461*b* of the layer 461 may be removed during a wafer washing step using a conventional wafer washer. After removal of the first and second layers 459 and 461 or sections 461*b* of the layer 461, the wafer 454 is diced into individual support substrates 252.

It is contemplated that the wafers 354 and 454 may be adhesively bonded together or coupled together such as by silicon fusion bonding, eutectic bonding, or anodic bonding, and then diced into separate spacer/support substrate assemblies. A nozzle plate/heater chip assembly is joined to each spacer/support substrate assembly after the spacer/substrate assembly chip is diced. It is preferred, however, that the wafers 354 and 454 be diced into separate spacers 254 and support substrates 252 with the spacers 254 then being bonded to the support substrates 252. A nozzle plate/heater chip assembly is then joined to each spacer/support substrate assembly.

Figure 11:
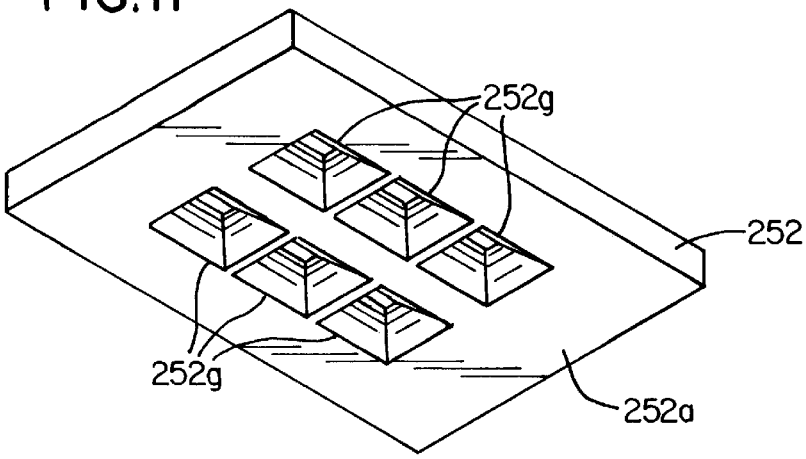
FIG. 11 is a perspective view of the support substrate of the chip carrier illustrated in FIG. 7.
Figure 14:
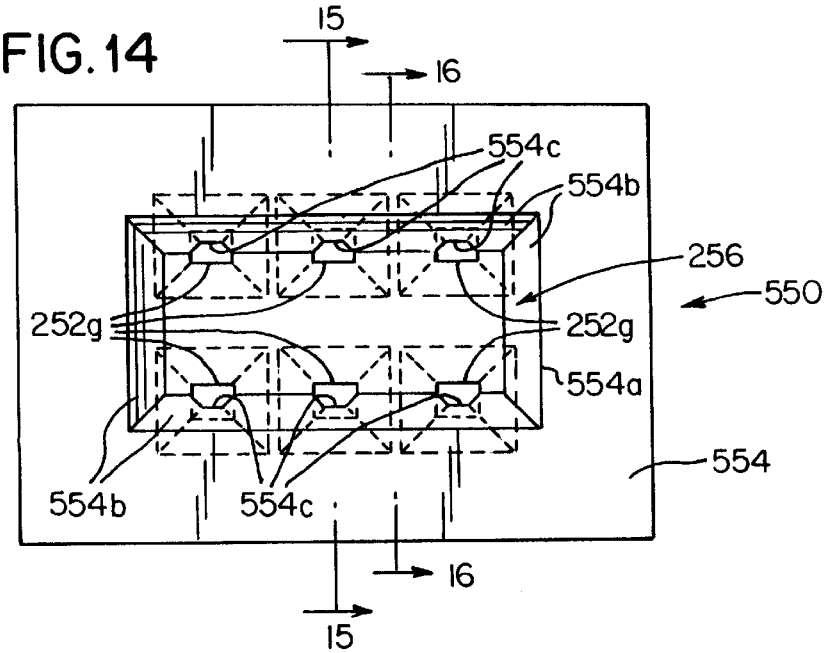
FIG. 14 is a plan view of a chip carrier formed in accordance with a third embodiment of the present invention.
Figure 15:
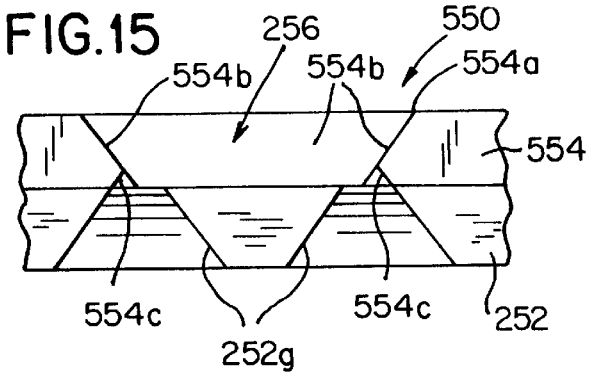
FIG. 15 is a view taken along view line 15—15 in FIG. 14.
Figure 16:
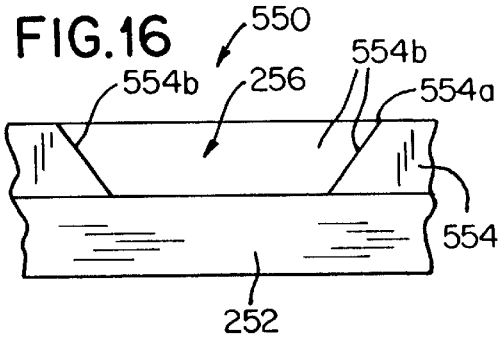
FIG. 16 is a view taken along view line 16—16 in FIG. 14.
Figure 17:
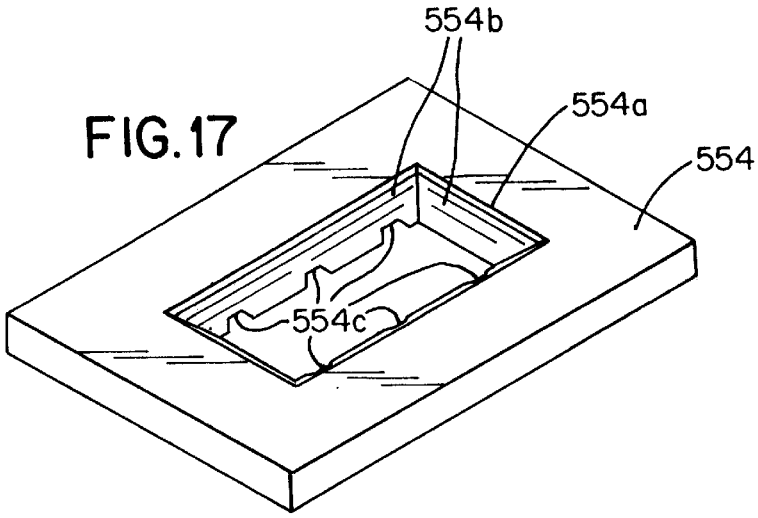
FIG. 17 is a perspective view of the spacer of the chip carrier illustrated in FIG. 14.

A carrier 550, formed in accordance with a third embodiment of the present invention, is shown in FIGS. 14–16, wherein like reference numerals indicate like elements. Here, the carrier 550 comprises a support substrate 252 and a spacer 554 secured to the support substrate 252. The support substrate 252 illustrated in FIGS. 7 and 11 is used in the FIG. 14 embodiment. The spacer 554 has a generally rectangular opening 554*a* defined by inner side walls 554*b*. Two of the inner side walls 554*b* include recesses 554*c* which are located substantially in-line with and over the channels 252*g* formed in the support substrate 252, see FIG. 14. The recesses 554*c* define extensions of the channels 252*g* through the spacer 554, see FIG. 15, so as to provide an enlarged flow path for ink to follow as it moves from the channels 252*g* into the inner cavity 256. In the illustrated embodiment, six recesses 554*c* are provided. However, less than six or more than six recesses 554*c* may be formed in the spacer 554.

The spacer 554 may be formed from the same material from which the spacer 254 is formed. The spacer 554 is adhesively secured to the support substrate 252 in the same manner that spacer 254 is secured to the support substrate 252 in the FIG. 7 embodiment.

The process for forming the spacer 554 will now be described with reference to FIGS. 18A–18E. A silicon wafer 654 (also referred to herein as a silicon plate) having a thickness $T_S$ of from about 400 microns to about 2500 microns and preferably from about 500 microns to about 1000 microns is provided. The thickness of the wafer 654 is not critical and may fall outside of this range. A plurality of spacers 554 are formed on a single wafer 654. For ease of illustration, only a portion of the wafer 654 is illustrated in FIGS. 18A–18E.

Figure 18A:
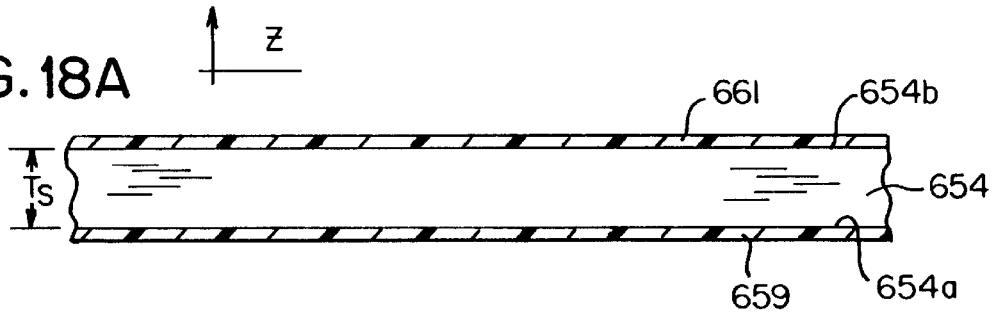
FIGS. 18A–18E are schematic cross sectional views illustrating the process for forming the spacer illustrated in FIG. 14.
Figure 18B:
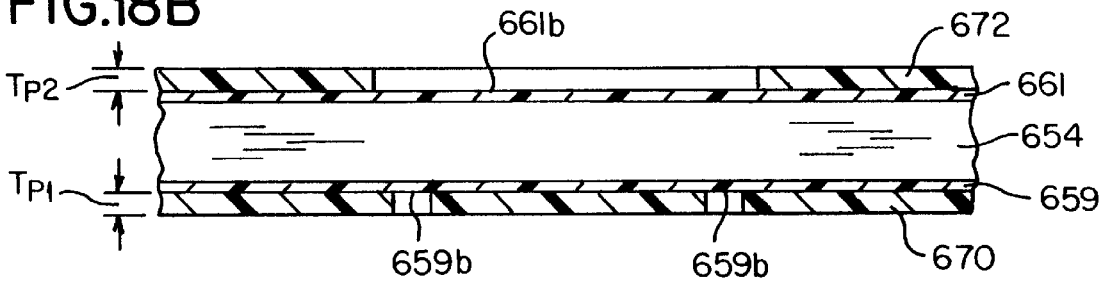

First and second etch resistant material layers 659 and 661 are formed on first and second sides 654*a* and 654*b* of the wafer 654, see FIG. 18A. The layers 659 and 661 may be formed from any one of a number of known etch resistant materials including, for example, silicon nitride, silicon carbide, aluminum, tantalum, silicon dioxide, and the like. In the illustrated embodiment, silicon nitride is deposited simultaneously onto the outer surfaces of the wafer 654 using a conventional low-pressure vapor deposition process or a plasma enhanced chemical vapor deposition process.

Alternatively, silicon dioxide layers may be thermally grown on the wafer 654, or aluminum or tantalum layers may be formed on the opposing wafer surfaces via a conventional sputter or evaporation process.

The first layer 659 has a thickness in the Z-direction, see FIG. 1 8A, of from about 1.0 micron to about 20 microns, and preferably from about 1.0 micron to about 2.5 microns. The second layer 661 has a thickness in the Z-direction of from about 1.0 micron to about 20 microns, and preferably from about 1.0 micron to about 2.5 microns.

After the first and second layers 659 and 661 are deposited onto the wafer 654, a first photoresist layer 670 is formed over the first etch resistant material layer 659 via a conventional spinning process. The layer 670 has a thickness $T_{P1}$ of from about 100 angstroms to about 50 microns, and preferably from about 1.0 micron to about 5.0 microns. The photoresist material may be a negative or a positive photoresist material. In the illustrated embodiment, the layer 670 is formed from a negative photoresist material which is commercially available from Olin Microelectronic Materials under the product designation "SC-100 Resist." After the photoresist layer 670 is spun onto the wafer 654, it is softbaked at an appropriate temperature so as to partially evaporate photoresist solvents to promote adhesion of the layer 670 to the first layer 659.

Figure 18C:
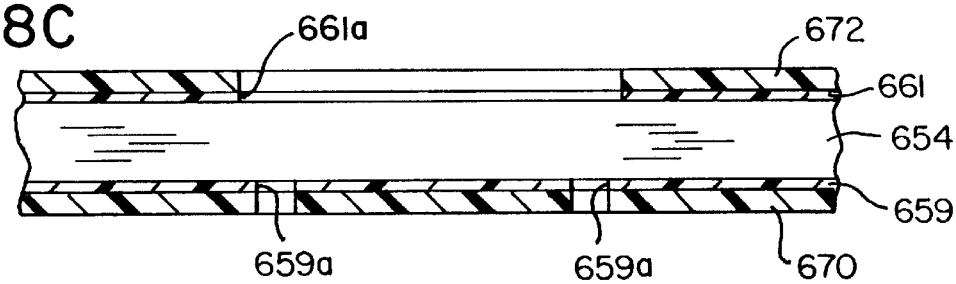
Figure 18D:
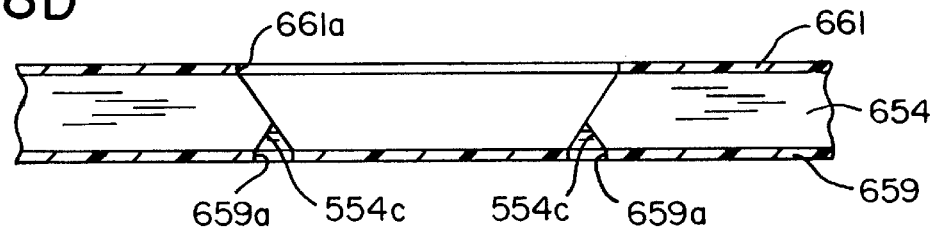
Figure 18E:
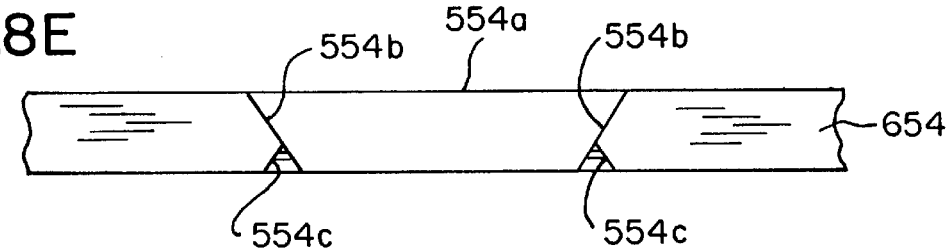

A first mask (not shown), having a plurality of blocked or covered areas which correspond to first openings 659*a* in the first layer 659, see FIG. 18C, is positioned over the first photoresist layer 670. Openings 659*a* may be rectangular, square or have another geometric shape. The first mask is aligned in a conventional manner such as to the wafer flat (not shown). Thereafter, unblocked portions of the first photoresist layer 670 are exposed to ultraviolet light to effect curing or polymerization of the exposed portions.

The first mask is then removed. Thereafter, the unexposed or uncured portions of the first photoresist layer 670 are removed in the same manner as the unpolymerized portions of the first photoresist layer 170, as described above. After the unpolymerized portions of the first photoresist layer 670 are removed from the wafer 654, portions 659*b* of the first etch resistant material layer 659 are exposed, see FIG. 18B.

Next, a second photoresist layer 672 is formed over the second etch resistant material layer 661 via a conventional spinning process. The layer 672 has a thickness $T_{P2}$ of from about 100 angstroms to about 50 microns, and preferably from about 1.0 micron to about 5.0 microns. The second photoresist material may be a negative or a positive photoresist material. In the illustrated embodiment, the layer 672 is formed from a negative photoresist material which is commercially available from Olin Microelectronic Materials under the product designation "SC-100 Resist." After the photoresist layer 672 is spun onto the wafer 654, it is softbaked at an appropriate temperature so as to partially evaporate photoresist solvents to promote adhesion of the layer 672 to the second layer 661.

A second mask (not shown), having a plurality of blocked or covered areas which correspond to one or more second openings 661*a* in the second layer 661, see FIG. 18C, is positioned over the second photoresist layer 672. The second mask is aligned in a conventional manner such as to the wafer flat (not shown). Thereafter, unblocked portions of the second photoresist layer 672 are exposed to ultraviolet light to effect curing or polymerization of the exposed portions. The second mask is then removed. Thereafter, the unexposed or uncured portions of the second photoresist layer 672 are removed in the same manner as the unpolymerized portions of the first photoresist layer 670. As can be seen from FIG. 18B, after the unpolymerized portions of the second photoresist layer 672 are removed from the wafer 654, one or more portions 661*b* of the second etch resistant material layer 661 are exposed.

Following the development of the first and second photoresist layers 670 and 672, the first and second layers 670 and 672 are hardbaked in a conventional manner so as to effect final evaporation of remaining solvents in the layers 670 and 672.

The patterns formed in the first and second photoresist layers 670 and 672 are transferred to the first and second etch resistant material layers 659 and 661, see FIG. 18C, using a conventional etching process. For example, a conventional reactive ion etching process may be used. When the first and second etch resistant material layers 659 and 661 are formed from silicon nitride, the reactive gas supplied to the reactive ion etcher is $CF_4$. For etching of aluminum, a chlorine gas may be supplied. When the layers 659 and 661 are formed from tantalum, a $CF_4$ gas is preferably provided.

After the patterns have been transferred to the first and second etch resistant material layers 659 and 661, the polymerized photoresist material remaining on the wafer 654 is removed in a conventional manner. For example, a conventional reactive ion etcher receiving an $O_2$ plasma may be used. Alternatively, a commercially available resist stripper such as one which is available from Olin Microelectronic Materials under the product designation "Microstrip" may be used.

Next, a micromachining step is implemented to form the one or more openings 554*a* and the recesses 554*c* in the silicon wafer 654. This step involves placing the wafer 654 in an etchant bath such that exposed portions of the silicon are etched away. The etching step is performed in essentially the same manner as the one described above for forming the channels 54*g* and the inner cavity 54*d* in the silicon wafer 154. When sufficient etching has occurred such that the one or more openings 554*a* and the recesses 554*c* are formed, see FIG. 18D, the wafer 654 is removed from the bath.

Thereafter, the first and second etch resistant material layers 659 and 661 may be removed using a conventional reactive ion etcher. Following removal of the first and second layer 659 and 661, the wafer 654 is diced into individual spacers 554. It is also contemplated that the first and second layers 659 and 661 may remain on the wafer 654 and, hence, on the spacers 554.

It is further contemplated that the carriers 52 and 250 may be formed so as to accommodate a center feed heater chip, such as the center feed heater chip disclosed in contemporaneously filed patent application entitled "AN INK JET HEATER CHIP MODULE," previously incorporated herein by reference. These modified carriers 52 and 250 include a single row of channels, e.g., three channels, which row is located centrally along the substrate portion 54*c*, 252*c* so as to provide a path for ink to pass from an inkfilled container to a centrally located via in the center feed heater chip. Of course, two or more rows of channels may be provided. Further, each row may include one, two or more than three channels.

What is claimed is:

1. A heater chip module comprising:

a carrier adapted to be secured to a container for receiving ink and including a recessed support section;

a heater chip having a plurality of resistive heating elements located on a base which is coupled to said carrier recessed support section, said recessed support section including at least two channels which define at least two paths for ink to travel from the container to said heater chip and said resistive heating elements and a rib positioned between said two channels, said heater chip contacting said rib and said rib providing a path for energy in the form of heat to travel from said heater chip to said carrier; and a nozzle plate positioned adjacent to said heater chip.

2. A heater chip module as set forth in claim 1, wherein said carrier comprises a support substrate and a spacer secured to said support substrate, said spacer having an opening defined by inner side walls, said support substrate having first and second outer surfaces and a portion which defines said carrier support section, an upper surface of said support substrate portion and said inner side walls of said spacer defining an inner cavity of said carrier, said heater chip being positioned in said inner cavity and said at least two channels communicating with said inner cavity.

3. A heater chip module as set forth in claim 2, wherein said inner cavity and said heater chip are sized such that at least one side portion of said heater chip is spaced from at least one of said inner side walls of said spacer.

4. A heater chip module as set forth in claim 2, wherein said heater chip comprises an edge feed beater chip.

5. A heater chip module as set forth in claim 2, wherein said heater chip comprises a center feed heater chip.

6. A heater chip module set forth in claim 2, wherein said spacer is formed from a material selected from group consisting of ceramics, metals, silicon and polymers.

7. A heater chip module as set forth in claim 2, wherein said support substrate is formed from silicon.

8. A heater chip module as set forth in claim 7, wherein said heater chip comprises a silicon base joined to said silicon support substrate.

9. A heater chip module as set forth in claim 2, wherein at least one of said channels is shaped like a truncated pyramid.

10. A heater chip module as set forth in claim 2, wherein at least one of said spacer inner side walls includes a recess.

11. A heater chip module as set forth in claim 1, wherein said chip carrier comprises a single layer substrate including upper and lower surfaces, a substrate portion provided with at least two channels, and an inner cavity defined by inner side walls and an upper surface of said substrate portion, said substrate portion defining said carrier support section, said at least two channels communicating with said inner cavity, and said heater chip being positioned in said inner cavity.

12. A heater chip module as set forth in claim 11, wherein said inner cavity and said heater chip are sized such that at least one side portion of said heater chip is spaced from at least one of said inner side walls of said single layer substrate.

13. A heater chip module as set forth in claim 11, wherein said heater chip comprises an edge feed heater chip.

14. A heater chip module as set forth in claim 11, wherein said heater chip comprises a center feed heater chip.

15. A heater chip module as set forth in claim 11, wherein said single layer substrate is formed from silicon.

16. A heater chip module as set forth in claim 15, wherein said heater chip comprises a silicon base joined to said substrate portion.

17. A heater chip module as set forth in claim 11, wherein at least one of said channels is shaped like a truncated pyramid.

18. A heater chip module as set forth in claim 1, wherein said at least two channels extend completely through said support section.

19. A heater chip module as set forth in claim 1, wherein said nozzle plate is coupled directly to said heater chip and said carrier.

* * * * *